US012742221B2

(12) United States Patent
Eguchi et al.

(10) Patent No.: US 12,742,221 B2
(45) Date of Patent: Sep. 22, 2026

(54) HIGH-STRENGTH STAINLESS STEEL SEAMLESS PIPE FOR OIL COUNTRY TUBULAR GOODS AND METHOD FOR MANUFACTURING SAME

(71) Applicant: JFE Steel Corporation, Tokyo (JP)

(72) Inventors: Kenichiro Eguchi, Tokyo (JP); Masao Yuga, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 324 days.

(21) Appl. No.: 18/273,370

(22) PCT Filed: Jan. 26, 2022

(86) PCT No.: PCT/JP2022/002813
§ 371 (c)(1),
(2) Date: Jul. 20, 2023

(87) PCT Pub. No.: WO2022/181164
PCT Pub. Date: Sep. 1, 2022

(65) Prior Publication Data

US 2024/0124949 A1 Apr. 18, 2024

(30) Foreign Application Priority Data

Feb. 26, 2021 (JP) ..... 2021-029638

(51) Int. Cl.

| | |
|---|---|
| ***C21D 9/08*** | (2006.01) |
| ***C21D 8/10*** | (2006.01) |
| ***C22C 38/00*** | (2006.01) |
| ***C22C 38/02*** | (2006.01) |
| ***C22C 38/06*** | (2006.01) |
| ***C22C 38/44*** | (2006.01) |
| ***C22C 38/46*** | (2006.01) |
| ***C22C 38/50*** | (2006.01) |
| ***C22C 38/52*** | (2006.01) |
| ***C22C 38/58*** | (2006.01) |
| ***C22C 38/60*** | (2006.01) |

(52) U.S. Cl.
CPC ..... *C21D 9/085* (2013.01); *C21D 8/10* (2013.01); *C22C 38/001* (2013.01); *C22C 38/002* (2013.01); *C22C 38/02* (2013.01); *C22C 38/06* (2013.01); *C22C 38/44* (2013.01); *C22C 38/46* (2013.01); *C22C 38/50* (2013.01); *C22C 38/52* (2013.01); *C22C 38/58* (2013.01); *C22C 38/60* (2013.01); *C21D 2211/001* (2013.01)

(58) Field of Classification Search
None
See application file for complete search history.

(56) References Cited

U.S. PATENT DOCUMENTS

| | | | | |
|---|---|---|---|---|
| 2009/0162239 | A1 | 6/2009 | Takabe et al. | |
| 2018/0237879 | A1 | 8/2018 | Motoya et al. | |
| 2019/0136337 | A1 | 5/2019 | Eguchi et al. | |
| 2019/0241989 | A1 | 8/2019 | Endo et al. | |
| 2020/0270715 | A1 | 8/2020 | Endo et al. | |
| 2020/0407814 | A1 | 12/2020 | Endo et al. | |
| 2021/0238705 | A1 | 8/2021 | Matsuo et al. | |
| 2021/0317556 | A1 | 10/2021 | Kanki et al. | |
| 2022/0033943 | A1* | 2/2022 | Kanki | C21D 6/005 |

FOREIGN PATENT DOCUMENTS

| | | | |
|---|---|---|---|
| CN | 101171351 | A | 4/2008 |
| CN | 108034888 | A | 5/2018 |
| EP | 3 690 074 | A1 | 8/2020 |
| EP | 3 845 680 | A1 | 7/2021 |
| JP | 07166303 | A | 6/1995 |
| JP | 09170019 | A | 6/1997 |
| JP | 2010168646 | A | 8/2010 |
| JP | 2010242163 | A | 10/2010 |
| WO | 2008023702 | A1 | 2/2008 |
| WO | 2017038178 | A1 | 3/2017 |
| WO | 2017168874 | A1 | 10/2017 |
| WO | 2018079111 | A1 | 5/2018 |
| WO | 2019065115 | A1 | 4/2019 |
| WO | 2019065116 | A1 | 4/2019 |
| WO | 2020067247 | A1 | 4/2020 |

(Continued)

OTHER PUBLICATIONS

Extended European Search Report issued Jun. 26, 2025, by the European Patent Office in corresponding European Patent Application No. 22759206.0-1103. (115 pages).
Office Action (Notice of Reasons for Refusal) issued Jan. 24, 2023, by the Japan Patent Office in corresponding Japanese Patent Application No. 2022-521683 and an English translation with Concise Statement of Relevance of the Office Action. (13 pages).
International Search Report and Written Opinion for International Application No. PCT/JP2022/002813 dated Apr. 5, 2022, 6 pages.
Office Action (The First Office Action) issued Jan. 22, 2026, by the State Intellectual Property Office of People's Republic of China in corresponding Chinese Patent Application No. 202280011507.X and an English translation with Concise explanation of relevance of the Office Action. (21 pages).

*Primary Examiner* — Jenny R Wu
(74) *Attorney, Agent, or Firm* — Buchanan Ingersoll & Rooney PC

(57) ABSTRACT

A high-strength stainless steel seamless pipe for oil country tubular goods has a composition that contains, in mass %, C: 0.012 to 0.05%, Si: 0.05 to 0.50%, Mn: 0.04 to 1.80%, P: 0.030% or less, S: 0.005% or less, Cr: 11.0 to 14.0%, Ni: 0.5 to 6.5%, Mo: 0.5 to 3.0%, Al: 0.005 to 0.10%, V: 0.005 to 0.20%, Co: 0.01 to 0.3%, N: 0.002 to 0.15%, O: 0.010% or less, and Ti: 0.001 to 0.20%, and in which Cr, Ni, Mo, Cu, C, Si, Mn, N, and Ti satisfy predetermined relations, and the balance is Fe and incidental impurities, the high-strength stainless steel seamless pipe having a steel microstructure with 6 to 20% retained austenite in terms of a volume percentage, a yield strength of 758 MPa or more, and an absorption energy $vE_{-60}$ at −60° C. of 70 J or more.

4 Claims, No Drawings

(56) References Cited

FOREIGN PATENT DOCUMENTS

| | | | |
|---|---|---|---|
| WO | 2020071344 | A1 | 4/2020 |
| WO | 2020071348 | A1 | 4/2020 |
| WO | 2020/095559 | A1 | 5/2020 |
| WO | 2021015141 | A1 | 1/2021 |

* cited by examiner

HIGH-STRENGTH STAINLESS STEEL SEAMLESS PIPE FOR OIL COUNTRY TUBULAR GOODS AND METHOD FOR MANUFACTURING SAME

CROSS REFERENCE TO RELATED APPLICATIONS

This is the U.S. National Phase application of PCT/JP2022/002813, filed Jan. 26, 2022, which claims priority to Japanese Patent Application No. 2021-029638, filed Feb. 26, 2021, the disclosures of these applications being incorporated herein by reference in their entireties for all purposes.

FIELD OF THE INVENTION

The present invention relates to a high-strength stainless steel seamless pipe for oil country tubular goods suited for applications such as in crude oil wells or natural gas wells and in gas wells (hereinafter, referred to simply as oil wells), and to a method for manufacturing such a high-strength stainless steel seamless pipe. Particularly, aspects of the invention relate to a high-strength stainless steel seamless pipe for oil country tubular goods having desirable carbon dioxide gas corrosion resistance and sulfide stress corrosion cracking resistance (SSC resistance) in extremely severe high-temperature corrosive environments of 150° C. or more containing carbon dioxide gas ($CO_2$) and chlorine ions ($Cl^-$), and to a method for manufacturing such a high-strength stainless steel seamless pipe.

BACKGROUND OF THE INVENTION

Increasing crude oil prices and an expected shortage of petroleum resources in the near future have prompted active development of oil fields and gas fields that were unthinkable in the past, for example, such as deep oil fields, and oil fields and gas fields of a severe corrosive environment containing hydrogen sulfide and other corrosive chemicals, or a sour environment as it is also called. Such oil fields and gas fields are usually very deep, and are found in a high-temperature atmosphere of a severe corrosive environment containing $CO_2$, $Cl^-$, and $H_2S$. Steel pipes for oil country tubular goods to be used in such environments need to be made of materials having desired high strength and corrosion resistance.

Oil country tubular goods used for extraction in oil fields and gas fields of an environment containing carbon dioxide gas ($CO_2$), chlorine ions ($Cl^-$), and the like often use 13Cr martensitic stainless steel pipes. The use of improved 13Cr martensitic stainless steels having reduced carbon contents and increased contents of other elements such as nickel and molybdenum is also expanding.

For example, PTL 1 to PTL 8 describe techniques developed in connection with such demands. PTL 1 discloses a martensitic stainless steel that contains, in mass %, C: 0.010 to 0.030%, Mn: 0.30 to 0.60%, P: 0.040% or less, S: 0.0100% or less, Cr: 10.00 to 15.00%, Ni: 2.50 to 8.00%, Mo: 1.00 to 5.00%, Ti: 0.050 to 0.250%, V: 0.25% or less, N: 0.07% or less, one or both of Si: 0.50% or less and Al: 0.10% or less, and the balance Fe and impurities, and that satisfies formula (1) $6.0 \leq Ti/C \leq 10.1$, and has a yield strength of 758 to 862 MPa.

PTL 2 discloses a method for manufacturing a martensitic stainless steel seamless pipe that contains a heat treatment of a martensitic stainless steel having a composition containing, in weight %, C: ≤0.050, Si: ≤0.5, Mn: ≤1.5, P: ≤0.03, S: ≤0.005, Cr: 11.0 to 14.0, Ni: 4.0 to 7.0, Mo: 1.0 to 2.5, Cu: 1.0 to 2.5, Al: ≤0.05, N: 0.01 to 0.10, and in which the balance is Fe and incidental impurities, wherein the heat treatment includes cooling the martensitic stainless steel to a temperature equal to or less than an Ms point after hot working, and heating the martensitic stainless steel to a temperature T of 550° C. or more and $Ac_1$ or less at an average heating rate from 500 to T° C. of 1.0° C./sec or more, followed by cooling to a temperature equal to or less than the Ms point.

PTL 3 discloses a high-strength martensitic stainless steel having improved stress corrosion cracking resistance, containing, in weight %, C: 0.06% or less, Cr: 12 to 16%, Si: 1.0% or less, Mn: 2.0% or less, Ni: 0.5 to 8.0%, Mo: 0.1 to 2.5%, Cu: 0.3 to 4.0%, and N: 0.05% or less, and having a δ-ferritic phase with an area percentage of 10% or less, and fine precipitates of Cu being dispersed in the base.

PTL 4 discloses a method for manufacturing a martensitic stainless steel seamless pipe for oil country tubular goods having high strength with a YS on the order of 95 ksi, and low hardness with an HRC of less than 27 on the Rockwell hardness scale C, and having improved SSC resistance. The method includes hardening and tempering a stainless steel seamless pipe having a composition containing, in mass %, C: 0.015% or less, N: 0.015% or less, Si: 1.0% or less, Mn: 2.0% or less, P: 0.020% or less, S: 0.010% or less, Al: 0.01 to 0.10%, Cr: 10 to 14%, Ni: 3 to 8%, Ti: 0.03 to 0.15%, N: 0.015% or less, one or two or more selected from Cu: 1 to 4%, Mo: 1 to 4%, W: 1 to 4%, and Co: 1 to 4%, and the balance Fe and incidental impurities, wherein the hardening is a process in which the stainless steel seamless pipe is heated to a temperature of 750 to 840° C. and quenched, and the tempering is a process in which the heated steel pipe is tempered at a temperature of 650° C. or less.

PTL 5 discloses a stainless steel pipe having a chemical composition that contains, in mass %, C: 0.02% or less, Si: 0.05 to 1.00%, Mn: 0.1 to 1.0%, P: 0.030% or less, S: 0.002% or less, Ni: 5.5 to 8%, Cr: 10 to 14%, Mo: 2 to 4%, V: 0.01 to 0.10%, Ti: 0.05 to 0.3%, Nb: 0.1% or less, Al: 0.001 to 0.1%, N: 0.05% or less, Cu: 0.5% or less, Ca: 0 to 0.008%, Mg: 0 to 0.05%, B: 0 to 0.005%, and the balance Fe and impurities, and that has a microstructure containing a martensitic phase, and a retained austenitic phase that is 12 to 18% in terms of a volume percentage, the martensitic phase having prior austenite grains with a grain size number of less than 8.0 in compliance with ASTM E112, and the stainless steel pipe having a yield strength of 550 to 700 MPa.

PTL 6 discloses a martensitic stainless steel seamless pipe for oil country tubular goods having a composition containing, in mass %, C: 0.035% or less, Si: 0.5% or less, Mn: 0.05 to 0.5%, P: 0.03% or less, S: 0.005% or less, Cu: 2.6% or less, Ni: 5.3 to 7.3%, Cr: 11.8 to 14.5%, Al: 0.1% or less, Mo: 1.8 to 3.0%, V: 0.2% or less, and N: 0.1% or less, and that satisfies specific formulae, and in which the balance is Fe and incidental impurities, the martensitic stainless steel seamless pipe having a yield stress of 758 MPa or more.

PTL 7 discloses a martensitic stainless steel seamless pipe for oil country tubular goods having a composition containing, in mass %, C: 0.010% or more, Si: 0.5% or less, Mn: 0.05 to 0.24%, P: 0.030% or less, S: 0.005% or less, Ni: 4.6 to 8.0%, Cr: 10.0 to 14.0%, Mo: 1.0 to 2.7%, Al: 0.1% or less, V: 0.005 to 0.2%, N: 0.1% or less, Ti: 0.06 to 0.25%, Cu: 0.01 to 1.0%, and Co: 0.01 to 1.0%, and that satisfies specific formulae, and in which the balance is Fe and incidental impurities, the martensitic stainless steel seamless pipe having a yield stress of 758 MPa or more.

PTL 8 discloses a martensitic stainless steel seamless pipe for oil country tubular goods having a composition containing, in mass %, C: 0.0010 to 0.0094%, Si: 0.5% or less, Mn: 0.05 to 0.5%, P: 0.030% or less, S: 0.005% or less, Ni: 4.6 to 7.3%, Cr: 10.0 to 14.5%, Mo: 1.0 to 2.7%, Al: 0.1% or less, V: 0.2% or less, N: 0.1% or less, Ti: 0.01 to 0.50%, Cu: 0.01 to 1.0%, and Co: 0.01 to 1.0%, and that satisfies specific formulae, and in which the balance is Fe and incidental impurities, the martensitic stainless steel seamless pipe having a yield stress of 758 MPa or more.

PATENT LITERATURE

PTL 1: WO2008/023702
PTL 2: JP-A-9-170019
PTL 3: JP-A-7-166303
PTL 4: JP-A-2010-242163
PTL 5: WO2017/038178
PTL 6: WO2018/079111
PTL 7: WO2019/065115
PTL 8: WO2019/065116

SUMMARY OF THE INVENTION

The development of oil fields and gas fields in increasingly severe corrosive environments has created a demand for steel pipes for oil country tubular goods having high strength, and desirable carbon dioxide gas corrosion resistance even in severe high-temperature corrosive environments of 150° C. or more containing carbon dioxide gas ($CO_2$) and chlorine ions ($Cl^-$). The development of oil fields and gas fields in increasingly severe environments has also created a demand for desirable sulfide stress corrosion cracking resistance (SSC resistance) also in severe corrosive environments. The increasing development of oil fields in cold climates also requires desirable low-temperature toughness.

Seamless steel pipes used as steel pipes for oil country tubular goods experience severe strains in the manufacturing process, and defects tend to occur on steel pipe surface in forming a pipe. To prevent this, desirable hot workability is also needed in a hot working process in manufacture of a seamless steel pipe.

The techniques described in PTL 1 to PTL 8 provide high strength and desirable carbon dioxide gas corrosion resistance. However, these techniques are not necessarily satisfactory in terms of low-temperature toughness.

It is accordingly an object according to aspects of the present invention to provide a solution to the problems of the related art, and provide a high-strength stainless steel seamless pipe for oil country tubular goods having superior hot workability and high strength with excellent carbon dioxide gas corrosion resistance, sulfide stress corrosion cracking resistance, and low-temperature toughness.

As used herein, "high strength" means having a yield strength YS of 110 ksi (758 MPa) or more.

As used herein, "superior hot workability" means having a percentage reduction (%) of cross section of 70% or more as measured when a round rod-shaped test specimen taken from a billet and having a diameter of 10 mm at a parallel portion is heated to 1,250° C. with a Gleeble tester, and held at the heated temperature for 100 seconds, and cooled to 1,000° C. at 1° C./sec, and is pulled to break after being held at 1,000° C. for 10 seconds.

As used herein, "excellent carbon dioxide gas corrosion resistance" means that a test specimen immersed for 14 days in a test solution (a 20 mass % NaCl aqueous solution; a liquid temperature of 150° C.; an atmosphere of 10 atm $CO_2$ gas) kept in an autoclave has a corrosion rate of 0.125 mm/y or less, and that the test specimen after the corrosion test does not have pitting corrosion that is 0.2 mm or larger in diameter upon inspection of a surface with a loupe at 10 times magnification.

As used herein, "excellent sulfide stress corrosion cracking resistance" means that a test specimen stressed in a $H_2S$-containing corrosive environment has low susceptibility to sulfide stress corrosion cracking in a sulfide stress corrosion cracking test (SSC test) that evaluates the susceptibility of a test specimen to cracking. Specifically, "excellent sulfide stress corrosion cracking resistance" means that a test specimen immersed in a test solution (a 10 mass % NaCl aqueous solution; a liquid temperature of 25° C.; $H_2S$: 0.1 bar, $CO_2$: 0.9 bar) having an adjusted pH of 4.5 by addition of 0.82 g/L sodium acetate and hydrochloric acid has no cracks even when kept in the solution for 720 hours under an applied stress 90% of the yield stress.

As used herein, "excellent low-temperature toughness" means an absorption energy $vE_{-60}$ of 70 J or more in a Charpy impact test at −60° C. (5-mm thick V-notch test specimen). The absorption energy $vE_{-60}$ is preferably 100 J or more, and is preferably 250 J or less.

These tests can be conducted using the methods described in the Examples section below.

In order to achieve the foregoing objects, the present inventors conducted intensive investigations of various factors that affect SSC resistance and low-temperature toughness in stainless steel pipes of different compositions. The studies found that amounts of retained austenite and the form of TiN need to be controlled within the appropriate ranges to achieve both SSC resistance and low-temperature toughness in a high-strength material having a YS on the order of 110 ksi.

To describe more specifically, while retained austenite improves the low-temperature toughness value, retained austenite also increases the susceptibility to hydrogen embrittlement, and decreases SSC resistance. By adding Ti and fixing N in the form of TiN, hardness and the susceptibility to hydrogen embrittlement can decrease to improve SSC resistance. However, the precipitated TiN promotes generation and propagation of cracking in a Charpy impact test, and decreases the low-temperature toughness value. It is accordingly important to control the form of TiN within the appropriate range.

In order to provide superior hot workability in a hot working process in manufacture of a seamless steel pipe, the fraction of δ ferrite needs to be prevented from exceeding a predetermined value in heating a billet. To this end, the ferrite-forming elements and the austenite-forming elements need to be added in appropriately adjusted amounts.

Cr, Ni, Mo, and Cu form dense corrosion products on steel pipe surface, and decrease the corrosion rate in a carbon dioxide gas environment. Carbon, on the other hand, binds to Cr, and decreases the level of Cr, which effectively acts to improve corrosion resistance. That is, the amounts of Cr, Ni, Mo, Cu, and C need to be appropriately adjusted to provide desirable corrosion resistance in a high-temperature carbon dioxide gas environment.

Aspects of the present invention were completed after further studies based on these findings, and are as follows.

[1] A high-strength stainless steel seamless pipe for oil country tubular goods having a composition that contains, in mass %, C: 0.012 to 0.05%, Si: 0.05 to 0.50%, Mn: 0.04 to 1.80%, P: 0.030% or less, S: 0.005% or less, Cr: 11.0 to 14.0%, Ni: 0.5 to 6.5%, Mo: 0.5 to 3.0%, Al: 0.005 to 0.10%, V: 0.005 to 0.20%, Co: 0.01 to 0.3%, N: 0.002 to 0.15%, O: 0.010% or less, and Ti: 0.001 to 0.20%, and that satisfies all of the following formula (1) to formula (3), and in which the balance is Fe and incidental impurities, the high-strength stainless steel seamless pipe having a steel microstructure with 6 to 20% retained austenite in terms of a volume percentage, the high-strength stainless steel seamless pipe having a yield strength of 758 MPa or more, the high-strength stainless steel seamless pipe having an absorption energy $vE_{-60}$ at −60° C. of 70 J or more, $$Cr+0.65\times Ni+0.6\times Mo+0.55\times Cu-20\times C\geq 15.0 \quad (1)$$

$$Cr+Mo+0.3\times Si-43.3\times C-0.4\times Mn-Ni-0.3\times Cu-9\times N\leq 11.0 \quad (2)$$

$$Ti\times N\leq 0.00070 \quad (3),$$

wherein Cr, Ni, Mo, Cu, C, Si, Mn, N, and Ti in the formula (1) to formula (3) represent the content of each element in mass %, and the content is zero for elements that are not contained.

[2] The high-strength stainless steel seamless pipe for oil country tubular goods according to [1], wherein the composition further contains, in mass %, one or two groups selected from the following group A and group B, Group A: one or two selected from Cu: 3.0% or less and W: 3.0% or less, Group B: one or two or more selected from Nb: 0.20% or less, Zr: 0.20% or less, B: 0.01% or less, REM: 0.01% or less, Ca: 0.0060% or less, Sn: 0.20% or less, Ta: 0.1% or less, Mg: 0.01% or less, and Sb: 0.50% or less.

[3] A method for manufacturing a high-strength stainless steel seamless pipe for oil country tubular goods of [1] or [2], the method including:

heating a steel pipe material of said composition to 1,100 to 1,300° C., and hot working the steel pipe material into a seamless steel pipe;

quenching in which the seamless steel pipe is reheated to a temperature equal to or greater than an $Ac_3$ transformation point, and cooled at a cooling rate of air cooling or faster until a surface temperature of the seamless steel pipe reaches a cooling stop temperature of 100° C. or less; and tempering in which the seamless steel pipe is heated to a tempering temperature that is 500° C. or more and less than an $Ac_1$ transformation point, and that satisfies the following formula (4), $$0 \leq -129.5 + 471\times C + 3.7\times Cr + 0.7\times Ni + 1.97\times Mo - 5\times Co + 0.12\times T \leq 20 \quad (4)$$

wherein Cr, Ni, Mo, Co, and C in the formula (4) represent the content of each element in mass %, and the content is zero for elements that are not contained, and T is the tempering temperature (° C.).

Aspects of the present invention can provide a high-strength stainless steel seamless pipe for oil country tubular goods having superior hot workability and excellent carbon dioxide gas corrosion resistance, and having excellent SSC resistance and low-temperature toughness, and high strength with a yield strength YS of 758 MPa or more.

DETAILED DESCRIPTION OF EMBODIMENTS OF THE INVENTION

Embodiments of the present invention are described below in detail.

The following describes the composition of a high-strength seamless steel pipe for oil country tubular goods according to aspects of the present invention, and the reasons for limiting the composition. In the following, "%" means percent by mass, unless otherwise specifically stated.

C: 0.012 to 0.05%

Carbon is an important element for increasing the strength of a martensitic stainless steel. In accordance with aspects of the present invention, carbon needs to be contained in an amount of 0.012% or more to precipitate the required retained austenite, and to provide the low-temperature toughness desired in accordance with aspects of the present invention. A carbon content of more than 0.05% decreases strength. A carbon content of more than 0.05% also decreases SSC resistance. For this reason, the C content is 0.012 to 0.05% in accordance with aspects of the present invention. In view of carbon dioxide gas corrosion resistance, the C content is preferably 0.030% or less. The C content is preferably 0.014% or more, more preferably 0.016% or more. The C content is more preferably 0.025% or less, even more preferably 0.020% or less.

Si: 0.05 to 0.50%

Si is an element that acts as a deoxidizing agent. This effect can be obtained with a Si content of 0.05% or more. A Si content of more than 0.50% decreases hot workability of intermediate products (e.g., billets) during manufacture of the product. The carbon dioxide gas corrosion resistance also decreases with a Si content of more than 0.50%. For this reason, the Si content is 0.05 to 0.50%. The Si content is preferably 0.10% or more, more preferably 0.15% or more. The Si content is preferably 0.40% or less, more preferably 0.30% or less.

Mn: 0.04 to 1.80%

Mn is an element that improves hot workability by inhibiting formation of δ ferrite during hot working. In accordance with aspects of the present invention, Mn needs to be contained in an amount of 0.04% or more. An excessively high Mn content has adverse effects on low-temperature toughness and SSC resistance. For this reason, the Mn content is 0.04 to 1.80%. The Mn content is preferably 0.05% or more, more preferably 0.10% or more. The Mn content is preferably 0.80% or less, more preferably 0.50% or less, even more preferably 0.26% or less.

P: 0.030% or Less

P is an element that decreases carbon dioxide gas corrosion resistance, pitting corrosion resistance, and SSC resistance. In accordance with aspects of the present invention, phosphorus is contained in preferably as small an amount as possible. However, an overly low P content leads to increased manufacturing costs. In order to be industrially implementable at relatively low costs without causing a serious impairment of characteristics, phosphorus is contained in an amount of 0.030% or less. The P content is preferably 0.020% or less. The lower limit of P content is not particularly limited. However, the preferred lower limit is 0.005% or more because overly low P contents lead to an increase of manufacturing cost, as noted above.

S: 0.005% or Less

S is contained in preferably as small an amount as possible because this element causes a serious decrease of hot workability, and decreases SSC resistance by segregating at prior austenite grain boundaries or by forming Ca inclusions. With a S content of 0.005% or less, the number density of Ca inclusions can be reduced, and segregation of sulfur at prior austenite grain boundaries can be reduced to provide the SSC resistance desired in accordance with aspects of the present invention. For these reasons, the S content is 0.005% or less. The S content is preferably 0.0020% or less, more preferably 0.0015% or less. The lower limit of S content is not particularly limited. However, the preferred lower limit is 0.0005% or more because overly low S contents lead to an increase of manufacturing cost.

Cr: 11.0 to 14.0%

Cr is an element that contributes to improving corrosion resistance by forming a protective layer. In accordance with aspects of the present invention, a Cr content of 11.0% or more is needed to provide high-temperature corrosion resistance. A Cr content of more than 14.0% encourages formation of retained austenite without martensite transformation. In this case, the stability of the martensitic phase decreases, and the strength desired in accordance with aspects of the present invention cannot be obtained. For this reason, the Cr content is 11.0 to 14.0%. The Cr content is preferably 11.5% or more, more preferably 12.0% or more. The Cr content is preferably 13.5% or less, more preferably 13.0% or less.

Ni: 0.5 to 6.5%

Ni is an element that acts to improve corrosion resistance by strengthening the protective layer. Ni increases steel strength by solid-solution strengthening, and improves the low-temperature toughness. These effects can be obtained with a Ni content of 0.5% or more. With a Ni content of 0.5% or more, hot workability also improves with reduced formation of a ferritic phase at high temperatures. A Ni content of more than 6.5% encourages formation of retained austenite without martensite transformation. This decreases the stability of the martensitic phase, and the strength decreases. For this reason, the Ni content is 0.5 to 6.5%. The Ni content is preferably 5.0% or more. The Ni content is preferably 6.0% or less.

Mo: 0.5 to 3.0%

Mo is an element that increases resistance to pitting corrosion due to $Cl^-$ and low pH. In accordance with aspects of the present invention, Mo needs to be contained in an amount of 0.5% or more. A Mo content of less than 0.5% causes decrease of corrosion resistance in severe corrosive environments. A Mo content of more than 3.0% causes formation of δ ferrite, and decreases hot workability and SSC resistance. For these reasons, the Mo content is 0.5 to 3.0%. The Mo content is preferably 1.5% or more, more preferably 1.7% or more. The Mo content is preferably 2.5% or less, more preferably 2.3% or less.

Al: 0.005 to 0.10%

Al is an element that acts as a deoxidizing agent. This effect can be obtained with an Al content of 0.005% or more. An Al content of more than 0.10% leads to excessive oxide amounts, and has adverse effects on low-temperature toughness. For these reasons, the Al content is 0.005 to 0.10%. The Al content is preferably 0.010% or more, and is preferably 0.03% or less.

V: 0.005 to 0.20%

V is an element that improves steel strength by precipitation hardening. This effect can be obtained with a V content of 0.005% or more. A V content of more than 0.20% decreases low-temperature toughness. For this reason, the V content is 0.005 to 0.20%. The V content is preferably 0.03% or more, and is preferably 0.08% or less.

Co: 0.01 to 0.3%

Co is an element that raises the Ms point and reduces the fraction of retained austenite, and improves strength and SSC resistance. This effect can be obtained with a Co content of 0.01% or more. A Co content of more than 0.3% decreases the low-temperature toughness value. For this reason, the Co content is 0.01 to 0.3%. The Co content is preferably 0.05% or more, more preferably 0.07% or more. The Co content is preferably 0.15% or less, more preferably 0.09% or less.

N: 0.002 to 0.15%

N is an element that greatly improves pitting corrosion resistance. This effect can be obtained with a N content of 0.002% or more. A N content of more than 0.15% decreases low-temperature toughness. For this reason, the N content is 0.002 to 0.15%. The N content is preferably 0.003% or more, more preferably 0.005% or more. The N content is preferably 0.06% or less, more preferably 0.05% or less.

O (Oxygen): 0.010% or Less

O (oxygen) exists as oxides in the steel, and has adverse effects on various characteristics. For this reason, oxygen should be contained in as small an amount as possible. Particularly, an O content of more than 0.010% causes a serious decrease of hot workability and SSC resistance. For this reason, the O content is 0.010% or less. The O content is preferably 0.006% or less, more preferably 0.004% or less.

Ti: 0.001 to 0.20%

Ti is an element that improves SSC resistance by fixing N in the form of TiN, and reducing the amount of retained austenite. This effect can be obtained with a Ti content of 0.001% or more. A Ti content of more than 0.20% causes precipitation of coarse TiN, and decreases low-temperature toughness. For this reason, the Ti content is 0.001 to 0.20%. The Ti content is preferably 0.003% or more, more preferably 0.01% or more, even more preferably 0.03% or more. The Ti content is preferably 0.15% or less, more preferably 0.10% or less.

In accordance with aspects of the present invention, the Cr, Ni, Mo, Cu, and C contents are confined in the foregoing ranges, and these elements satisfy the following formula (1).

$$\mathrm{Cr}+0.65\times\mathrm{Ni}+0.6\times\mathrm{Mo}+0.55\times\mathrm{Cu}-20\times C\geq 15.0 \quad (1)$$

In formula (1), Cr, Ni, Mo, Cu, and C represent the content of each element in mass %, and the content is zero for elements that are not contained.

When the value on the left-hand side of formula (1) (the value of Cr+0.65×Ni+0.6×Mo+0.55× Cu−20×C) is less than 15.0, the carbon dioxide gas corrosion resistance in a high-temperature corrosive environment of 150° C. or more containing $CO_2$ and $Cl^-$ decreases. For this reason, in accordance with aspects of the present invention, Cr, Ni, Mo, Cu, and C are contained to satisfy formula (1). The value on the left-hand side of formula (1) is preferably 15.5 or more. The value on the left-hand side of formula (1) does not particularly require an upper limit. In view of reducing cost increase due to excessive addition of alloys and reducing decrease of strength, the value on the left-hand side of formula (1) is preferably 18.0 or less.

In accordance with aspects of the present invention, Cr, Mo, Si, C, Mn, Ni, Cu, and N are contained to satisfy the following formula (2).

$$Cr + Mo + 0.3 \times Si - 43.3 \times C - 0.4 \times Mn - Ni - 0.3 \times Cu - 9 \times N \leq 11.0 \quad (2)$$

In formula (2), Cr, Mo, Si, C, Mn, Ni, Cu, and N represent the content of each element in mass %, and the content is zero for elements that are not contained.

When the value on the left-hand side of formula (2) (the value of Cr+Mo+0.3×Si−43.3×C−0.4×Mn−Ni−0.3×Cu−9×N) is more than 11.0, it is not possible to obtain hot workability high enough to form the stainless steel seamless pipe, and steel pipe manufacturability decreases. For this reason, in accordance with aspects of the present invention, Cr, Mo, Si, C, Mn, Ni, Cu, and N are contained to satisfy formula (2). The value on the left-hand side of formula (2) is preferably 10.0 or less. The value on the left-hand side of formula (2) does not particularly require a lower limit. However, the value on the left-hand side of formula (2) is preferably 5 or more because the effect becomes saturated below this range.

In accordance with aspects of the present invention, Ti and N are contained to satisfy the following formula (3).

$$Ti \times N \leq 0.00070 \quad (3)$$

In formula (3), Ti and N represent the content of each element in mass %, and the content is zero for elements that are not contained.

When the value on the left-hand side of formula (3) (Ti×N) is more than 0.00070, coarse TiN precipitates, and the low-temperature toughness desired in accordance with aspects of the present invention cannot be obtained. For this reason, Ti and N are contained to satisfy formula (3) in accordance with aspects of the present invention. The value on the left-hand side of formula (3) is preferably 0.00060 or less, more preferably 0.00050 or less. The value on the left-hand side of formula (3) does not particularly require a lower limit. However, the value on the left-hand side of formula (3) is preferably 0.00003 or more because the effect becomes saturated below this range.

In accordance with aspects of the present invention, the balance in the composition above is iron (Fe) and incidental impurities.

The components described above represent the basic components. A high-strength stainless steel seamless pipe for oil country tubular goods according to aspects of the present invention can have the desired characteristics by containing these basic components and by satisfying all of the formulae (1) to (3) above. In accordance with aspects of the present invention, the following optional elements may be contained as needed, in addition to the basic components. The following components Cu, W, Nb, Zr, B, REM, Ca, Sn, Ta, Mg, and Sb are optional, and may be 0%.

One or Two Selected from Cu: 3.0% or Less and W: 3.0% or Less Cu: 3.0% or Less

Cu, an optional element, is an element that increases corrosion resistance by strengthening the protective layer. This effect can be obtained with a Cu content of 0.05% or more. A Cu content of more than 3.0% causes precipitation of CuS at grain boundaries, and decreases hot workability. For this reason, Cu, when contained, is contained in an amount of preferably 3.0% or less. The Cu content is preferably 0.05% or more, more preferably 0.5% or more, even more preferably 0.7% or more. The Cu content is more preferably 2.5% or less, even more preferably 1.1% or less.

W: 3.0% or Less

W, an optional element, is an element that contributes to increasing strength. This effect can be obtained with a W content of 0.05% or more. The effect becomes saturated with a W content of more than 3.0%. For this reason, W, when contained, is contained in an amount of preferably 3.0% or less. The W content is preferably 0.05% or more, more preferably 0.5% or more. The W content is more preferably 1.5% or less.

One or Two or More Selected from Nb: 0.20% or Less, Zr: 0.20% or Less, B: 0.01% or Less, REM: 0.01% or Less, Ca: 0.0060% or Less, Sn: 0.20% or Less, Ta: 0.1% or Less, Mg: 0.01% or Less, and Sb: 0.50% or Less Nb: 0.20% or Less Nb, an optional element, is an element that increases strength. This effect can be obtained with a Nb content of 0.01% or more. The effect becomes saturated with a Nb content of more than 0.20%. For this reason, Nb, when contained, is contained in an amount of preferably 0.20% or less. The Nb content is preferably 0.01% or more, more preferably 0.05% or more, even more preferably 0.07% or more. The Nb content is more preferably 0.15% or less, even more preferably 0.13% or less.

Zr: 0.20% or Less

Zr, an optional element, is an element that contributes to increasing strength. This effect can be obtained with a Zr content of 0.01% or more. The effect becomes saturated with a Zr content of more than 0.20%. For this reason, Zr, when contained, is contained in an amount of preferably 0.20% or less. The Zr content is preferably 0.01% or more, more preferably 0.03% or more. The Zr content is more preferably 0.05% or less.

B: 0.01% or Less

B, an optional element, is an element that contributes to increasing strength. This effect can be obtained with a B content of 0.0005% or more. Hot workability decreases with a B content of more than 0.01%. For this reason, B, when contained, is contained in an amount of preferably 0.01% or less. The B content is preferably 0.0005% or more, more preferably 0.0007% or more. The B content is more preferably 0.005% or less.

REM: 0.01% or Less

A REM (rare-earth metal), an optional element, is an element that contributes to improving corrosion resistance. This effect can be obtained with a REM content of 0.0005% or more. A REM content of more than 0.01% is economically disadvantageous because the effect becomes saturated, and the effect expected from the increased content cannot be obtained with a REM content of more than 0.01%. For this reason, REM, when contained, is contained in an amount of preferably 0.01% or less. The REM content is preferably 0.0005% or more, more preferably 0.001% or more. The REM content is more preferably 0.005% or less.

Ca: 0.0060% or Less

Ca, an optional element, is an element that contributes to improving hot workability. This effect can be obtained with a Ca content of 0.0005% or more. A Ca content of more than 0.0060% increases the number density of coarse Ca inclusions, and fails to provide the desired SSC resistance. For this reason, Ca, when contained, is contained in an amount of preferably 0.0060% or less. The Ca content is preferably 0.0005% or more, more preferably 0.0010% or more. The Ca content is more preferably 0.0040% or less.

Sn: 0.20% or Less

Sn, an optional element, is an element that contributes to improving corrosion resistance. This effect can be obtained with a Sn content of 0.02% or more. A Sn content of more than 0.20% is economically disadvantageous because the effect becomes saturated, and the effect expected from the increased content cannot be obtained with a Sn content of more than 0.20%. For this reason, Sn, when contained, is contained in an amount of preferably 0.20% or less. The Sn content is preferably 0.02% or more, more preferably 0.04% or more. The Sn content is more preferably 0.15% or less.

Ta: 0.1% or Less

Ta is an element that increases strength, and has the effect to improve sulfide stress corrosion cracking resistance (SSC resistance). Ta also has the same effect produced by Nb, and some of Nb may be replaced by Ta. These effects can be obtained with a Ta content of 0.01% or more. A Ta content of more than 0.1% decreases toughness. For this reason, Ta, when contained, is contained in an amount of preferably 0.1% or less. The Ta content is preferably 0.01% or more, more preferably 0.03% or more. The Ta content is more preferably 0.08% or less.

Mg: 0.01% or Less

Mg, an optional element, is an element that improves corrosion resistance. This effect can be obtained with a Mg content of 0.002% or more. When Mg is contained in an amount of more than 0.01%, the effect becomes saturated, and Mg cannot produce the effect expected from the increased content. For this reason, Mg, when contained, is contained in an amount of preferably 0.01% or less. The Mg content is preferably 0.002% or more, more preferably 0.004% or more. The Mg content is more preferably 0.008% or less.

Sb: 0.50% or Less

Sb, an optional element, is an element that contributes to improving corrosion resistance. This effect can be obtained with an Sb content of 0.02% or more. An Sb content of more than 0.50% is economically disadvantageous because the effect becomes saturated, and the effect expected from the increased content cannot be obtained with an Sb content of more than 0.50%. For this reason, Sb, when contained, is contained in an amount of preferably 0.50% or less. The Sb content is preferably 0.02% or more, more preferably 0.04% or more. The Sb content is more preferably 0.3% or less.

The following describes the steel microstructure of a high-strength stainless steel seamless pipe for oil country tubular goods according to aspects of the present invention, and the reasons for limiting the microstructure.

The steel microstructure of a high-strength stainless steel seamless pipe for oil country tubular goods according to aspects of the present invention is a duplex structure of martensite and retained austenite. To provide the strength desired in accordance with aspects of the present invention, the steel microstructure has martensite (tempered martensite) as a primary phase. As used herein, "primary phase" refers to a microstructure that accounts for at least 45% of the whole steel pipe in terms of a volume percentage. The volume percentage of martensite is preferably 70% or more, more preferably 80% or more. The volume percentage of martensite is 94% or less.

In accordance with aspects of the present invention, the steel microstructure includes retained austenite that is 6 to 20% of the whole steel pipe in terms of a volume percentage. Retained austenite is inherently low in strength, and has a high low-temperature toughness value, and, accordingly, when the volume percentage of retained austenite is less than 6%, the low-temperature toughness desired in accordance with aspects of the present invention cannot be obtained when the yield strength is 758 MPa or more. On the other hand, strength decreases when the volume percentage of retained austenite exceeds 20%. When in excess of 20%, retained austenite also transforms into hard martensite under applied stress, and the SSC resistance decreases. For this reason, the volume percentage of retained austenite is 6 to 20%. The volume percentage of retained austenite is preferably 8% or more, more preferably 10% or more. The volume percentage of retained austenite is preferably 18% or less, more preferably 16% or less.

In order to control the amount of retained austenite within the foregoing ranges, the composition and heat treatment conditions need to be confined in predetermined ranges, as follows. In accordance with aspects of the present invention, the composition and tempering conditions (described later) are controlled to satisfy the following formula (4).

$$0 \leq -129.5+471\times C+3.7\times Cr+0.7\times Ni+1.97\times Mo-5\times Co+0.12\times T \leq 20 \quad (4)$$

In formula (4), Cr, Ni, Mo, Co, and C represent the content of each element in mass %, and the content is zero for elements that are not contained. T represents the tempering temperature (° C.).

The basis for these limitations in formula (4) will be described later in conjunction with the manufacturing method, and is not discussed here.

In the steel microstructure, ferrite represents the remainder other than martensite and retained austenite.

In view of providing hot workability, the total volume percentage of the remainder microstructure is preferably less than 5%, more preferably 3% or less of the whole steel pipe.

The microstructure can be measured as follows.

First, a test specimen for microstructure observation is taken from a middle portion of the wall thickness on a cross section orthogonal to the pipe axis. The test specimen is then corroded with a Vilella's solution (a mixed reagent containing picric acid, hydrochloric acid, and ethanol in proportions of 2 g, 10 ml, and 100 ml, respectively), and the structure is imaged with a scanning electron microscope (1,000×). The fraction of the ferrite (area percent) in the microstructure is then calculated as a volume percentage, using an image analyzer.

Separately, an X-ray diffraction test specimen is ground and polished to have a measurement cross section (C cross section) orthogonal to the pipe axis, and the amount of retained austenite (γ) is measured by an X-ray diffraction method. The amount of retained austenite is determined by measuring X-ray diffraction integral intensity for the (220) plane of the γ phase, and the (211) plane of the α (ferrite) phase, and converting the calculated values using the following formula.

$$\gamma\,(\text{volume percentage}) = 100/(1 + (I\alpha R\gamma / I\gamma R\alpha)),$$

wherein Iα is the integral intensity of α, Rα is the crystallographic theoretical value for α, Iγ is the integral intensity of γ, and Rγ is the crystallographic theoretical value for γ.

The fraction (volume percentage) of martensite (tempered martensite) is the remainder other than ferrite and the retained γ phase.

The following describes a preferred embodiment of a method for manufacturing a high-strength stainless steel seamless pipe for oil country tubular goods according to aspects of the present invention.

In accordance with aspects of the present invention, a steel pipe material of the composition described above is used as a starting material. The method of manufacture of a steel pipe material used as a starting material is not particularly limited. For example, a molten steel of the foregoing composition is made using a steelmaking process such as by using a converter, and formed into a steel pipe material, for example, a billet, using a method such as continuous casting or ingot casting-billeting.

The steel pipe material is heated, and hot worked into a pipe by a tubing process such as the Mannesmann-plug mill process or Mannesmann-mandrel mill process. This forms a seamless steel pipe having the foregoing composition and desired dimensions (predetermined shape). The seamless steel pipe may be produced by hot extrusion using a pressing method.

For example, in the steel pipe material heating step, the heating temperature ranges from 1,100 to 1,300° C. A heating temperature of less than 1,100° C. decreases hot workability, and produces large numbers of defects during pipe formation. A high heating temperature of more than 1,300° C. causes coarsening of crystal grains, and decreases low-temperature toughness. For these reasons, the heating temperature in the heating step is 1,100 to 1,300° C.

Preferably, the seamless steel pipe formed is cooled to room temperature at a cooling rate of air cooling or faster. In this way, the steel pipe can have a microstructure containing martensite as a primary phase.

In accordance with aspects of the present invention, the cooling of the steel pipe to room temperature at a cooling rate of air cooling or faster is followed by quenching, in which the steel pipe (seamless steel pipe after tubing) is reheated to a temperature (heating temperature) equal to or more than an $Ac_3$ transformation point, and, after being held for a predetermined time period, is cooled at a cooling rate of air cooling or faster until the surface temperature of the seamless steel pipe reaches a temperature of 100° C. or less (cooling stop temperature).

By this quenching process, the martensite can be refined while achieving high strength. In view of preventing coarsening of the microstructure, the quenching heating temperature (reheating temperature) is preferably 800 to 950° C. The quenching heating temperature is more preferably 880° C. or more, and is more preferably 940° C. or less. In view of ensuring soaking, the reheating temperature is retained for preferably at least 5 minutes. The amount of time for the quenching is preferably at most 30 minutes.

When the cooling stop temperature is more than 100° C., the amount of retained austenite excessively increases, and the desired strength and SSC resistance cannot be obtained. For this reason, the cooling stop temperature is 100° C. or less. The cooling stop temperature is preferably 80° C. or less.

Here, "cooling rate of air cooling or faster" means 0.01° C./s or faster.

The steel pipe is tempered after quenching. In tempering, the steel pipe is heated to a temperature (tempering temperature) that is 500° C. or more and less than an $Ac_1$ transformation point, and that satisfies formula (4), and the heated steel pipe is air cooled after being held for a predetermined time period. Here, the steel pipe may be water cooled, instead of air cooling.

When the tempering temperature is equal to or more than the $Ac_1$ transformation point, the fresh martensite precipitates after tempering, and the desired high strength cannot be provided. When the tempering temperature is less than 500° C., the strength overly increases, and it becomes difficult to obtain the desired low-temperature toughness.

For these reasons, the tempering temperature is 500° C. or more and less than an $Ac_1$ transformation point. In this way, the microstructure can have tempered martensite as a primary phase, and the seamless steel pipe can have the desired strength and the desired corrosion resistance. The tempering temperature is preferably 560° C. or more, and is preferably 630° C. or less. In view of ensuring soaking of the material, the tempering temperature is retained for preferably at least 10 minutes. The amount of time for the tempering is preferably at most 300 minutes.

In accordance with aspects of the present invention, the amount of retained austenite needs to be controlled within the foregoing ranges, as described above. To this end, in manufacture of the seamless steel pipe, the composition and heat treatment conditions (tempering conditions) are controlled to satisfy the following formula (4).

$$0 \leq -129.5 + 471 \times C + 3.7 \times Cr + 0.7 \times Ni + 1.97 \times 5 \times + 0.12 \times T \leq 20 \quad (4)$$

In formula (4), Cr, Ni, Mo, Co, and C represent the content of each element in mass %, and the content is zero for elements that are not contained. T represents the tempering temperature (° C.).

When the value in the middle of formula (4) (the value of (−129.5+471×C+3.7× Cr+0.7×Ni+1.97× Mo−5×Co+0.12× T)) is less than 0, the amount of retained austenite becomes insufficient, and the low-temperature toughness desired in accordance with aspects of the present invention cannot be obtained. When the value in the middle of formula (4) is more than 20, the amount of retained austenite overly increases, and the high strength desired in accordance with aspects of the present invention cannot be obtained.

For this reason, in accordance with aspects of the present invention, the composition and heat treatment conditions are controlled within predetermined ranges to satisfy formula (4). The value in the middle of formula (4) is preferably 2 or more, and is preferably 18 or less. The value in the middle of formula (4) is more preferably 2.5 or more, and is more preferably 13 or less.

For the reasons described above, the tempering temperature according to aspects of the present invention is a temperature that is 500° C. or more and less than an $Ac_1$ transformation point, and that satisfies formula (4).

The $Ac_3$ transformation point and $Ac_1$ transformation point are values actually measured from changes in the expansion rate (coefficient of linear expansion) of a test specimen (0=3 mm×length L=10 mm) upon heating at 15° C./min and cooling.

While the seamless steel pipe has been described as an example, the present invention is not limited to this. For example, a steel pipe for oil country tubular goods may be produced by forming a steel pipe material of the foregoing composition into an electric resistance welded steel pipe or a UOE steel pipe. By quenching and tempering such a steel pipe for oil country tubular goods under the conditions described above, a steel pipe for oil country tubular goods can be obtained that has the characteristics achieved by aspects of the present invention.

In accordance with aspects of the present invention, the intermediate products (e.g., billets) produced during manufacture of the product can have properties with desirable hot workability. It is accordingly possible to produce a high-strength stainless steel seamless pipe for oil country tubular goods having excellent carbon dioxide gas corrosion resistance, excellent SSC resistance, excellent low-temperature toughness with an absorption energy $vE_{-60}$ at −60° C. of 70 J or more, and high strength with a yield strength YS of 758 MPa or more.

EXAMPLES

Aspects of the present invention are described below through Examples. It is to be noted that the present invention is not limited by the following Examples.

Steels of the compositions shown in Table 1 were made using a vacuum melting furnace, and formed into billets (steel pipe materials) by hot forging. The steel pipe material was heated at the heating temperatures shown in Table 2, and hot worked into a steel pipe using a model seamless rolling mill. The steel pipe was then air cooled to produce a seamless steel pipe. Table 2 also shows the dimensions of the seamless steel pipes produced.

The blanks in Table 1 indicate that the element was not added intentionally, meaning that the element is absent (0%), or may be incidentally present.

The seamless steel pipe was cut to prepare a test specimen material. The test specimen material was taken in such an orientation that the longitudinal direction of the test specimen was along the pipe axis. The test specimen material from each seamless steel pipe was subjected to quenching in which the test specimen material was heated at the heating temperature (reheating temperature) for the duration of the soaking time shown in Table 2, and air cooled to the cooling stop temperature shown in Table 2. This was followed by tempering in which the test specimen material was heated at the tempering temperature for the duration of the soaking time shown in Table 2, and air cooled.

The test specimen material was evaluated for tensile properties, corrosion characteristics, SSC resistance, hot workability, and low-temperature toughness, using the methods described below. The test specimen material was also measured for microstructure, as follows.

Evaluation of Tensile Properties

An arc-shaped tensile test specimen (gauge length: 50 mm, width: 12.5 mm) was taken from the quenched and tempered test specimen material, and was subjected to a tensile test as specified by ASTM (American Standard Test Method) E8/E8M-16ae1 to determine tensile properties (yield strength YS, tensile strength TS). The test specimen was considered as having passed the test when it had a yield strength YS of 758 MPa or more, and having failed the test when the yield strength YS was less than 758 MPa.

Evaluation of Corrosion Characteristics

A corrosion test specimen of a size measuring 3 mm in thickness, 30 mm in width, and 40 mm in length was prepared by machining the quenched and tempered test specimen material, and was subjected to a corrosion test.

The corrosion test was conducted by immersing the test specimen for 14 days in a test solution (a 20 mass % NaCl aqueous solution; liquid temperature: 150° C.; an atmosphere of 10 atm $CO_2$ gas) kept in an autoclave. The corrosion rate was determined from the calculated reduction in the weight of the tested specimen measured before and after the corrosion test. Here, the steel was considered as having passed the test when it had a corrosion rate of 0.125 mm/y or less, and having failed the test when the corrosion rate was more than 0.125 mm/y.

The test specimen after the corrosion test was observed for the presence or absence of pitting corrosion on its surface, using a loupe at 10 times magnification. Here, pitting corrosion is present when pitting corrosion of a diameter equal to or greater than 0.2 mm was observed. Pitting corrosion is absent when there was no observable pitting corrosion, or when pitting corrosion of a diameter less than 0.2 mm was present. In the test, the test specimen was considered as having passed the test when it did not have pitting corrosion ("Absent" in Table 3), and having failed the test when it had pitting corrosion ("Present" in Table 3).

The test specimen was determined as having desirable carbon dioxide gas corrosion resistance when the evaluation results for corrosion rate and pitting corrosion were both satisfactory in the tests described above.

Evaluation of SSC Resistance

An SSC test refers to a collection of tests conducted to evaluate the susceptibility of a test specimen to cracking under applied stress in a $H_2S$-containing corrosive environment. In Examples, the SSC test was conducted in compliance with NACE TM0177, Method A. The test was carried out in a test environment using an aqueous solution prepared by adjusting the pH of a 10 mass % NaCl aqueous solution (liquid temperature: 25° C., $H_2S$: 0.1 bar, $CO_2$: 0.9 bar) to 4.5 by addition of 0.82 g/L sodium acetate and hydrochloric acid, and the test specimen was immersed in the solution for 720 hours under an applied stress 90% of the yield stress. The test specimen was considered as having passed the test when it did not have a crack after the test ("Absent" in Table 3), and having failed the test when the test specimen had a crack after the test ("Present" in Table 3).

Evaluation of Hot Workability

For evaluation of hot workability, a round rod-shaped test specimen taken from a billet and having a diameter of 10 mm at a parallel portion was heated to 1,250° C. with a Gleeble tester, and held at the heated temperature for 100 seconds, and cooled to 1,000° C. at 1° C./sec, and was pulled to break after being held at 1,000° C. for 10 seconds. The test specimen was then measured for a percentage reduction (%) of cross section. The test specimen was considered as having passed the test and having superior hot workability when the percentage reduction of cross section was 70% or more. Test specimens that had a percentage reduction of cross section of less than 70% were considered as having failed the test.

Evaluation of Low-Temperature Toughness

A Charpy impact test was conducted in compliance with JIS Z 2242: 2018, using a V-notch test specimen (5-mm thick) taken from the test specimen in such an orientation that the longitudinal direction was along the pipe axis. The test was conducted at −60° C., and the absorption energy $vE_{-60}$ at −60° C. was determined for evaluation of low-temperature toughness. Three test specimens were used for each run, and the arithmetic mean value from these test specimens was determined as an absorption energy (J). In the test, the test specimen was determined as having passed the test and having desirable low-temperature toughness when it had an absorption energy $vE_{-60}$ at −60° C. of 70 J or more. The test specimen was determined as having failed the test when it had an absorption energy $vE_{-60}$ at −60° C. of less than 70 J.

Measurement of Microstructure

For the measurement of microstructure, a test specimen for microstructure observation was prepared from the quenched and tempered test specimen material. The microstructure was observed on a cross section orthogonal to the pipe axis. The test specimen for microstructure observation was corroded with a Vilella's solution (a mixed reagent containing picric acid, hydrochloric acid, and ethanol in proportions of 2 g, 10 ml, and 100 ml, respectively), and the microstructure was imaged with a scanning electron microscope (1,000×). The fraction of the ferrite phase (area percent) in the microstructure was then calculated as a volume percentage, using an image analyzer.

Separately, an X-ray diffraction test specimen was ground and polished to have a measurement cross section (C cross section) orthogonal to the pipe axis, and the amount of retained austenite (γ) is measured by an X-ray diffraction method. The amount of retained austenite was determined by measuring X-ray diffraction integral intensity for the (220) plane of the γ phase, and the (211) plane of the α (ferrite) phase, and converting the calculated values using the following formula.

$$\gamma\,(\text{volume percentage}) = 100/(1 + (I\alpha R\gamma / I\gamma R\alpha)),$$

wherein Iα was the integral intensity of α, Rα was the crystallographic theoretical value for α, Iγ was the integral intensity of γ, and Rγ was the crystallographic theoretical value for γ.

The fraction (volume percentage) of martensite (tempered martensite) was the remainder other than ferrite and the retained γ phase.

The results were presented in Table 3.

TABLE 1

| Steel species No. | Composition (mass %) C | Si | Mn | P | S | Cr | Ni | Mo | Al | V | Co | N | O | Cu | Ti | W | Nb, Zr, B, REM, Ca, Sn, Ta, Mg, Sb | Value on left-hand side of formula (1)*1 | Value on left-hand side of formula (2)*2 | Value on left-hand side of formula (3)*3 | Remarks |
|---|---|---|---|---|---|---|---|---|---|---|---|---|---|---|---|---|---|---|---|---|---|
| A | 0.020 | 0.22 | 0.17 | 0.011 | 0.001 | 12.2 | 5.55 | 2.05 | 0.035 | 0.022 | 0.01 | 0.0100 | 0.0018 | | 0.003 | | Ca: 0.0023 | 16.6 | 7.7 | 0.00003 | Present Steel |
| B | 0.022 | 0.18 | 0.38 | 0.015 | 0.001 | 12.9 | 5.41 | 2.17 | 0.049 | 0.008 | 0.03 | 0.0541 | 0.0014 | | 0.003 | | | 17.3 | 8.1 | 0.00016 | Present Steel |
| C | 0.012 | 0.18 | 0.35 | 0.017 | 0.001 | 12.2 | 5.87 | 2.14 | 0.037 | 0.012 | 0.10 | 0.0052 | 0.0017 | | 0.010 | | Ca: 0.0014 | 17.1 | 7.8 | 0.00005 | Present Steel |
| D | 0.025 | 0.19 | 0.42 | 0.010 | 0.001 | 12.8 | 5.47 | 2.15 | 0.046 | 0.005 | 0.03 | 0.0538 | 0.0009 | 0.92 | 0.002 | | | 17.7 | 7.5 | 0.00011 | Present Steel |
| E | 0.024 | 0.22 | 0.35 | 10.011 | 0.001 | 12.9 | 5.35 | 2.22 | 0.047 | 0.010 | 0.02 | 0.0545 | 0.0010 | | 0.003 | 0.56 | | 17.2 | 8.2 | 0.00016 | Present Steel |
| F | 0.021 | 0.17 | 0.39 | 0.014 | 0.001 | 12.9 | 5.38 | 2.18 | 0.045 | 0.005 | 0.06 | 0.0492 | 0.0029 | | 0.002 | | Nb: 0.013 | 17.3 | 8.2 | 0.00010 | Present Steel |
| G | 0.027 | 0.19 | 0.41 | 0.011 | 0.001 | 12.9 | 5.39 | 2.14 | 0.048 | 0.008 | 0.02 | 0.0511 | 0.0011 | | 0.003 | | Zr: 0.02, Sn: 0.068 | 17.1 | 7.9 | 0.00015 | Present Steel |
| H | 0.020 | 0.23 | 0.37 | 0.018 | 0.001 | 13.0 | 5.49 | 2.22 | 0.048 | 0.005 | 0.04 | 0.0521 | 0.0002 | | 0.003 | | B: 0.003, REM: 0.004, Mg: 0.003 | 17.5 | 8.3 | 0.00016 | Present Steel |
| I | 0.014 | 0.18 | 0.38 | 0.018 | 0.001 | 12.1 | 5.88 | 2.12 | 0.037 | 0.013 | 0.07 | 0.0079 | 0.0008 | | 0.013 | | Sb: 0.068, Ta: 0.03 | 16.9 | 7.6 | 0.00010 | Present Steel |
| J | 0.020 | 0.18 | 0.38 | 0.016 | 0.001 | 12.8 | 4.40 | 0.97 | 0.020 | 0.008 | 0.06 | 0.0379 | 0.0014 | | 0.003 | | | 15.8 | 8.1 | 0.00011 | Present Steel |
| K | 0.012 | 0.25 | 0.40 | 0.016 | 0.001 | 12.4 | 5.84 | 1.95 | 0.027 | 0.046 | 0.01 | 0.0140 | 0.0024 | | 0.013 | | | 17.2 | 7.9 | 0.00018 | Present Steel |
| L | 0.012 | 0.25 | 0.40 | 0.017 | 0.001 | 12.1 | 5.48 | 1.93 | 0.044 | 0.049 | 0.23 | 0.0068 | 0.0025 | | 0.009 | | | 16.6 | 8.0 | 0.00006 | Present Steel |
| M | 0.055 | 0.19 | 0.38 | 0.016 | 0.001 | 12.8 | 5.43 | 2.19 | 0.049 | 0.003 | 0.07 | 0.0580 | 0.0032 | | | | | 16.5 | 6.6 | 0 | Comparative Example |
| N | 0.020 | 0.20 | 0.39 | 0.010 | 0.001 | 14.2 | 5.48 | 2.25 | 0.047 | 0.009 | 0.05 | 0.0565 | 0.0010 | | | | | 18.7 | 9.5 | 0 | Comparative Example |
| O | 0.024 | 0.15 | 0.39 | 0.019 | 0.001 | 10.8 | 5.39 | 2.17 | 0.053 | 0.009 | 0.02 | 0.0569 | 0.0010 | | | | | 15.1 | 5.9 | 0 | Comparative Example |
| P | 0.013 | 0.14 | 0.34 | 0.021 | 0.001 | 12.2 | 6.70 | 2.15 | 0.032 | 0.010 | 0.09 | 0.0053 | 0.0037 | | 0.007 | | | 17.6 | 6.9 | 0.00004 | Comparative Example |
| Q | 0.019 | 0.22 | 0.36 | 0.012 | 0.001 | 12.8 | 0.30 | 0.98 | 0.017 | 0.013 | 0.06 | 0.0380 | 0.0013 | | | | | 13.2 | 12.2 | 0 | Comparative Example |
| R | 0.008 | 0.14 | 0.32 | 0.015 | 0.001 | 12.2 | 5.91 | 3.16 | 0.039 | 0.010 | 0.08 | 0.0075 | 0.0023 | | 0.010 | | | 17.8 | 9.0 | 0.00008 | Comparative Example |
| S | 0.021 | 0.20 | 0.37 | 0.018 | 0.001 | 12.9 | 4.31 | 0.40 | 0.018 | 0.009 | 0.10 | 0.0339 | 0.0020 | | | | | 15.5 | 7.7 | 0 | Comparative Example |
| T | 0.014 | 0.22 | 0.42 | 0.020 | 0.001 | 12.5 | 5.83 | 1.90 | 0.024 | 0.043 | 0.04 | 0.0382 | 0.0036 | | 0.019 | | | 17.1 | 7.5 | 0.00073 | Comparative Example |
| U | 0.017 | 0.17 | 0.20 | 0.013 | 0.001 | 12.2 | 5.64 | 2.00 | 0.031 | 0.025 | 0.38 | 0.0145 | 0.0019 | | | | | 16.7 | 7.7 | 0 | Comparative Example |

*1: $Cr + 0.65 \times Ni + 0.6 \times Mo + 0.55 \times Cu - 20 \times C \geq 15.0$ ..(1)

*2: $Cr + Mo + 0.3 \times Si - 43.3 \times C - 0.4 \times Mn - Ni - 0.3 \times Cu - 9 \times N \leq 11.0$ ..(2)

*3: $Ti \times N \leq 0.00070$ ..(3)

*4: The blanks indicate that the element was not added intentionally, meaning that the element is absent (0%), or may be incidentally present.

TABLE 2

| Steel pipe No. | Steel species No. | Dimensions of steel pipe: Outside diameter (mm) | Dimensions of steel pipe: thickness Wall (mm) | Heating temp. of steel pipe material (° C.) | Heat treatment: Quenching: Heating temp. (° C.) | Quenching: Soaking time (min.) | Quenching: Cooling | Quenching: Cooling stop temp. (° C.) | Tempering: Tempering temp. (° C.) | Tempering: Soaking time (min.) | Tempering: Cooling |
|---|---|---|---|---|---|---|---|---|---|---|---|
| 1 | A | 88.9 | 6.45 | 1263 | 912 | 11 | Air cooling | 16 | 599 | 20 | Air cooling |
| 2 | B | 88.9 | 6.45 | 1236 | 920 | 17 | Air cooling | 28 | 591 | 29 | Air cooling |
| 3 | C | 88.9 | 6.45 | 1256 | 914 | 19 | Air cooling | 25 | 616 | 23 | Air cooling |
| 4 | D | 88.9 | 6.45 | 1230 | 914 | 13 | Air cooling | 16 | 610 | 40 | Air cooling |
| 5 | E | 88.9 | 6.45 | 1245 | 913 | 27 | Air cooling | 15 | 597 | 55 | Air cooling |
| 6 | F | 88.9 | 6.45 | 1262 | 934 | 13 | Air cooling | 28 | 610 | 48 | Air cooling |
| 7 | G | 88.9 | 6.45 | 1245 | 934 | 30 | Air cooling | 30 | 590 | 27 | Air cooling |
| 8 | H | 88.9 | 6.45 | 1244 | 933 | 26 | Air cooling | 16 | 590 | 56 | Air cooling |
| 9 | I | 88.9 | 6.45 | 1259 | 907 | 19 | Air cooling | 30 | 592 | 26 | Air cooling |
| 10 | J | 88.9 | 6.45 | 1267 | 922 | 14 | Air cooling | 24 | 610 | 24 | Air cooling |
| 11 | K | 88.9 | 6.45 | 1247 | 914 | 19 | Air cooling | 17 | 577 | 46 | Air cooling |
| 12 | L | 88.9 | 6.45 | 1247 | 918 | 13 | Air cooling | 26 | 579 | 51 | Air cooling |
| 13 | M | 88.9 | 6.45 | 1253 | 915 | 19 | Air cooling | 26 | 601 | 42 | Air cooling |
| 14 | N | 88.9 | 6.45 | 1246 | 927 | 25 | Air cooling | 28 | 602 | 28 | Air cooling |
| 15 | O | 88.9 | 6.45 | 1262 | 915 | 15 | Air cooling | 26 | 606 | 37 | Air cooling |
| 16 | P | 88.9 | 6.45 | 1256 | 932 | 26 | Air cooling | 28 | 604 | 28 | Air cooling |
| 17 | Q | 88.9 | 6.45 | 1260 | 936 | 17 | Air cooling | 24 | 604 | 28 | Air cooling |
| 18 | R | 88.9 | 6.45 | 1237 | 913 | 18 | Air cooling | 28 | 593 | 28 | Air cooling |
| 19 | S | 88.9 | 6.45 | 1254 | 904 | 28 | Air cooling | 23 | 600 | 53 | Air cooling |
| 20 | T | 88.9 | 6.45 | 1270 | 933 | 15 | Air cooling | 25 | 610 | 22 | Air cooling |
| 21 | U | 88.9 | 6.45 | 1252 | 925 | 29 | Air cooling | 19 | 600 | 57 | Air cooling |

| Steel pipe No. | $Ac_1$ transformation point (° C.) | $AC_3$ transformation point (° C.) | Value in the middle of formula (4)* |
|---|---|---|---|
| 1 | 603 | 725 | 4.9 |
| 2 | 624 | 761 | 8.5 |
| 3 | 621 | 705 | 2.6 |
| 4 | 614 | 749 | 9.5 |
| 5 | 601 | 768 | 9.6 |
| 6 | 626 | 762 | 7.9 |
| 7 | 623 | 760 | 10.8 |
| 8 | 631 | 765 | 8.0 |
| 9 | 602 | 699 | 1.8 |
| 10 | 647 | 786 | 4.0 |
| 11 | 584 | 714 | −1.4 |
| 12 | 580 | 716 | −3.9 |
| 13 | 612 | 750 | 23.5 |
| 14 | 722 | 830 | 12.5 |
| 15 | 609 | 741 | 1.7 |
| 16 | 610 | 753 | 2.2 |
| 17 | 889 | 910 | 0.6 |
| 18 | 595 | 729 | 1.4 |
| 19 | 645 | 781 | 3.4 |
| 20 | 620 | 719 | 3.0 |
| 21 | 602 | 713 | 1.6 |

*$0 \leq -129.5 + 471 \times C + 3.7 \times Cr + 0.7 \times Ni + 1.97 \times Mo - 5 \times Co + 0.12 \times T \leq 20$ ..(4)

TABLE 3

| Steel pipe No. | Steel species No. | Steel microstructure: Volume percentage of martensitic phase (%) | Steel microstructure: Volume percentage of retained austenite phase (%) | Hot workability: Percentage reduction of cross section (%) | Tensile properties: Yield strength YS (MPa) | Tensile properties: Tensile strength TS (MPa) | Low-temperature toughness VE-60 (J) | Corrosion properties: Corrosion rate (mm/y) | Corrosion properties: Pitting corrosion | Corrosion properties: SSC resistance SSC | Remarks |
|---|---|---|---|---|---|---|---|---|---|---|---|
| 1 | A | 91 | 9 | 79 | 863 | 1019 | 215.4 | 0.032 | Absent | Absent | Present Example |
| 2 | B | 87 | 13 | 74 | 871 | 1090 | 218.3 | 0.020 | Absent | Absent | Present Example |
| 3 | C | 94 | 6 | 83 | 811 | 902 | 115.0 | 0.022 | Absent | Absent | Present Example |
| 4 | D | 87 | 13 | 77 | 896 | 1097 | 225.3 | 0.016 | Absent | Absent | Present Example |

TABLE 3-continued

| Steel pipe No. | Steel species No. | Steel microstructure: Volume percentage of martensitic phase (%) | Steel microstructure: Volume percentage of retained austenite phase (%) | Hot workability: Percentage reduction of cross section (%) | Tensile properties: Yield strength YS (MPa) | Tensile properties: Tensile strength TS (MPa) | Low-temperature toughness VE-60 (J) | Corrosion properties: Corrosion rate (mm/y) | Corrosion properties: Pitting corrosion | Corrosion properties: SSC resistance SSC | Remarks |
|---|---|---|---|---|---|---|---|---|---|---|---|
| 5 | E | 87 | 13 | 81 | 873 | 1103 | 220.1 | 0.020 | Absent | Absent | Present Example |
| 6 | F | 88 | 12 | 77 | 868 | 1082 | 215.6 | 0.018 | Absent | Absent | Present Example |
| 7 | G | 83 | 17 | 77 | 879 | 1124 | 212.0 | 0.020 | Absent | Absent | Present Example |
| 8 | H | 86 | 14 | 74 | 873 | 1082 | 215.2 | 0.016 | Absent | Absent | Present Example |
| 9 | I | 93 | 7 | 75 | 820 | 921 | 149.2 | 0.027 | Absent | Absent | Present Example |
| 10 | J | 90 | 10 | 83 | 857 | 1009 | 211.6 | 0.063 | Absent | Absent | Present Example |
| 11 | K | 98 | 2 | 75 | 838 | 909 | 31.4 | 0.022 | Absent | Absent | Comparative Example |
| 12 | L | 99 | 1 | 83 | 842 | 915 | 26.5 | 0.034 | Absent | Absent | Comparative Example |
| 13 | M | 72 | 28 | 83 | 724 | 1160 | 226.1 | 0.037 | Absent | Present | Comparative Example |
| 14 | N | 74 | 26 | 72 | 742 | 1084 | 216.8 | 0.006 | Absent | Present | Comparative Example |
| 15 | O | 86 | 14 | 85 | 867 | 1097 | 217.6 | 0.128 | Absent | Absent | Comparative Example |
| 16 | P | 75 | 25 | 84 | 752 | 964 | 210.0 | 0.014 | Absent | Present | Comparative Example |
| 17 | Q | 93 | 7 | 63 | 755 | 884 | 73.0 | 0.874 | Present | Present | Comparative Example |
| 18 | R | 94 | 6 | 69 | 802 | 893 | 59.0 | 0.014 | Absent | Present | Comparative Example |
| 19 | S | 91 | 9 | 81 | 865 | 1008 | 212.8 | 0.079 | Present | Present | Comparative Example |
| 20 | T | 92 | 8 | 81 | 816 | 935 | 63.6 | 0.023 | Absent | Absent | Comparative Example |
| 21 | U | 93 | 7 | 78 | 860 | 1012 | 69.0 | 0.035 | Absent | Absent | Comparative Example |

The present examples all had a yield strength YS of 758 MPa or more, and superior hot workability with a percentage reduction of cross section of 70% or more. The carbon dioxide gas corrosion resistance (corrosion resistance) in a high-temperature corrosive environment of 150° C. or more containing $CO_2$ and $Cl^-$, and the SSC resistance and low-temperature toughness were also desirable in all of the present examples.

The values obtained in Comparative Examples that did not fall in the ranges according to aspects of the present invention were not desirable in at least one of yield strength YS, hot workability, carbon dioxide gas corrosion resistance, SSC resistance, and low-temperature toughness.

The invention claimed is:

1. A high-strength stainless steel seamless pipe for oil country tubular goods having a composition that comprises, in mass %, C: 0.012 to 0.05%,
Si: 0.05 to 0.50%,
Mn: 0.04 to 1.80%,
P: 0.030% or less,
S: 0.005% or less,
Cr: 11.0 to 14.0%,
Ni: 0.5 to 6.5%,
Mo: 0.5 to 3.0%,
Al: 0.005 to 0.10%,
V: 0.005 to 0.20%,
Co: 0.01 to 0.3%,
N: 0.002 to 0.15%,
O: 0.010% or less, and
Ti: 0.001 to 0.20%, and that satisfies all of the following formula (1) to formula (3), and in which the balance is Fe and incidental impurities, the high-strength stainless steel seamless pipe having a steel microstructure with 6 to 20% retained austenite in terms of a volume percentage, the high-strength stainless steel seamless pipe having a yield strength of 758 MPa or more, the high-strength stainless steel seamless pipe having an absorption energy $vE_{-60}$ at −60° C. of 70 J or more, $$Cr + 0.65 \times Ni + 0.6 \times Mo + 0.55 \times Cu - 20 \times C \geq 15.0 \quad (1)$$

$$Cr + Mo + 0.3 \times Si - 43.4 \times C - 0.4 \times Mn - Ni - 0.3 \times Cu - 9 \times N \leq 11.0 \quad (2)$$

$$Ti \times N \leq 0.00016, \quad (3)$$

wherein Cr, Ni, Mo, Cu, C, Si, Mn, N, and Ti in the formula (1) to formula (3) represent the content of each element in mass %, and the content is zero for elements that are not contained.

2. The high-strength stainless steel seamless pipe for oil country tubular goods according to claim 1, wherein the composition further comprises, in mass %, one or two groups selected from the following group A and group B, Group A: one or two selected from Cu: 3.0% or less and W: 3.0% or less, Group B: one or two or more selected from Nb: 0.20% or less, Zr: 0.20% or less, B: 0.01% or less, REM: 0.01% or less, Ca: 0.0060% or less, Sn: 0.20% or less, Ta: 0.1% or less, Mg: 0.01% or less, and Sb: 0.50% or less.

3. A method for manufacturing a high-strength stainless steel seamless pipe for oil country tubular goods of claim 1, the method comprising:

heating a steel pipe material of said composition to 1,100 to 1,300° C., and hot working the steel pipe material into a seamless steel pipe;

quenching in which the seamless steel pipe is reheated to a temperature equal to or greater than an $Ac_3$ transformation point, and cooled at a cooling rate of air cooling or faster until a surface temperature of the seamless steel pipe reaches a cooling stop temperature of 100° C. or less; and tempering in which the seamless steel pipe is heated to a tempering temperature that is 500° C. or more and less than an $Ac_1$ transformation point, and that satisfies the following formula (4), $$0 \leq -129.5 + 471 \times C + 3.7 \times Cr + 0.7 \times Ni + 1.97 \times Mo - 5 \times Co + 0.12 \times T \leq 20 \quad (4)$$

wherein Cr, Ni, Mo, Co, and C in the formula (4) represent the content of each element in mass %, and the content is zero for elements that are not contained, and T is the tempering temperature (° C.).

4. A method for manufacturing a high-strength stainless steel seamless pipe for oil country tubular goods of claim 2, the method comprising:

heating a steel pipe material of said composition to 1,100 to 1,300° C., and hot working the steel pipe material into a seamless steel pipe;

quenching in which the seamless steel pipe is reheated to a temperature equal to or greater than an Acs transformation point, and cooled at a cooling rate of air cooling or faster until a surface temperature of the seamless steel pipe reaches a cooling stop temperature of 100° C. or less; and tempering in which the seamless steel pipe is heated to a tempering temperature that is 500° C. or more and less than an Ac transformation point, and that satisfies the following formula (4), $$0 \leq -129.5 + 471 \times C + 3.7 \times Cr + 0.7 \times Ni + 1.97 \times Mo - 5 \times Co + 0.12 \times T \leq 20 \quad (4)$$

wherein Cr, Ni, Mo, Co, and C in the formula (4) represent the content of each element in mass %, and the content is zero for elements that are not contained, and T is the tempering temperature (C).

* * * * *